US012428984B2

(12) United States Patent
Kramer et al.

(10) Patent No.: US 12,428,984 B2
(45) Date of Patent: Sep. 30, 2025

(54) CLAMP, ADAPTER AND TRAVEL LIMITER ASSEMBLY

(71) Applicant: Tenneco Automotive Operating Company LLC, Northville, MI (US)

(72) Inventors: Joseph R. Kramer, Washtenaw, MI (US); Gary Figi, Grass Lake, MI (US); Mathew D. Ferraiuolo, Pittsford, MI (US)

(73) Assignee: Tenneco Automotive Operating Company LLC, Northville, MI (US)

( * ) Notice: Subject to any disclaimer, the term of this patent is extended or adjusted under 35 U.S.C. 154(b) by 0 days.

(21) Appl. No.: 18/679,594

(22) Filed: May 31, 2024

(65) Prior Publication Data

US 2025/0035028 A1 Jan. 30, 2025

Related U.S. Application Data

(60) Provisional application No. 63/528,479, filed on Jul. 24, 2023.

(51) Int. Cl.

| | |
|---|---|
| ***F16L 23/08*** | (2006.01) |
| ***F01N 13/08*** | (2010.01) |
| ***F01N 13/18*** | (2010.01) |

(52) U.S. Cl.

CPC ..... *F01N 13/1844* (2013.01); *F01N 13/082* (2013.01); *F01N 2450/20* (2013.01)

(58) Field of Classification Search

CPC ..... F16L 23/003; F16L 23/006; F16L 23/024; F16L 23/04; F16L 23/08; F01N 13/1844

See application file for complete search history.

(56) References Cited

U.S. PATENT DOCUMENTS

| | | | |
|---|---|---|---|
| 10,837,344 | B2 | 11/2020 | Kilbreath et al. |
| 11,156,315 | B2 | 10/2021 | Paes et al. |
| 11,454,156 | B2 | 9/2022 | Koehler |
| 11,619,330 | B2 | 4/2023 | Drivon et al. |
| 2005/0264010 | A1 | 12/2005 | Wagner |
| 2018/0259103 | A1* | 9/2018 | Ignaczak ..... F01N 13/1805 |

FOREIGN PATENT DOCUMENTS

| | | |
|---|---|---|
| FR | 2925647 A3 | 6/2009 |
| FR | 3133423 A1 | 9/2023 |

* cited by examiner

*Primary Examiner* — Aaron M Dunwoody
(74) *Attorney, Agent, or Firm* — Harness, Dickey & Pierce, P.L.C.

(57) ABSTRACT

A clamp, adapter and travel limiter assembly couples first and second exhaust devices. The assembly comprises an adapter including a hollow body portion including a first end configured to be fixed to the first exhaust device. The adapter includes a portion extending from the hollow body portion. A clamp removably couples the first and second exhaust devices to one another. The clamp is coupled to the adapter via a travel limiter. The clamp remains movable relative to the adapter after the clamp is coupled to the adapter.

19 Claims, 12 Drawing Sheets

CLAMP, ADAPTER AND TRAVEL LIMITER ASSEMBLY

CROSS-REFERENCE TO RELATED APPLICATIONS

This application claims the benefit of U.S. Provisional Application No. 63/528,479, filed on Jul. 24, 2023. The entire disclosure of the application referenced above is incorporated herein by reference.

FIELD

The present disclosure generally relates to joints in automotive exhaust systems. More particularly, a clamp, adapter and travel limiter assembly for the joint is provided.

BACKGROUND

Exhaust systems are useful for transferring and sometimes treating the exhaust emitted from an internal combustion engine. The exhaust system may include several portions of conduit or pipe connected to one another. Exhaust devices are often implemented to reduce the sound emitted from the exhaust exiting the internal combustion engine. Other types of exhaust devices may be provided to reduce the concentration of undesirable emissions including hydrocarbons, carbon monoxide, nitric oxide, and the like. Exhaust systems associated with emissions from diesel fueled engines may include additional or alternate components including diesel particulate filters and selective catalytic reduction devices. Exhaust systems may include a variety of other components such as exhaust manifolds and turbo chargers in addition to the conduits and exhaust devices interconnected to one another such that an uninterrupted flow path exists from the engine's combustion chambers to an outlet of a tailpipe.

Typically, the exhaust conduits and the exhaust devices are interconnected using a flange and clamp system. Each adjacent exhaust system component may include a hollow cylindrical section terminating at a radially outwardly extending flange. Adjacent flanges may be removably coupled together by a clamp such as a V-band clamp. V-band clamps may be constructed from three or more components including a clamp band, a threaded bolt, and a threaded nut.

The clamp assemblies are sometimes transported separately from or together with corresponding exhaust devices. During shipping and handling of the exhaust devices, it has been discovered that the clamp components may become lost or otherwise separated from the exhaust devices. Cost and time may be needlessly expended to find the clamps or obtain replacement hardware. During assembly of the exhaust system, other challenges may arise when attempting to concurrently align adjacent flanges of conduits and exhaust devices with one another while aligning the clamp over the flanges and attempting to tightening the clamp fasteners. Accordingly, a need exists for an improved clamp assembly to overcome these challenges.

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A clamp, adapter and travel limiter assembly is provided to couple first and second exhaust devices of an internal combustion engine exhaust system. The assembly comprises an adapter including a hollow body portion including a first end and an opposite second end. The first end is configured to be fixed to the first exhaust device. The adapter includes a radially outwardly extending flange portion at the second end and a post extending radially outwardly from the flange portion. A clamp is operable to removably couple the first and second exhaust devices to one another and includes a clamp band circumferentially extending above the flange portion. The clamp band includes an aperture extending therethrough of the post. A travel limiter is coupled to the post and restricts removal of the clamp from the post. The travel limiter is spaced apart from the clamp band at a position radially outward from the clamp band such that the clamp band remains movable relative to the adapter after the travel limiter is coupled to the post.

In another arrangement, a clamp, adapter and travel limiter assembly for coupling first and second exhaust devices of an internal combustion engine exhaust system includes an adapter including a hollow body portion including a first end and an opposite second end. The first end is configured to be fixed to the first exhaust device. The adapter includes a radially outwardly extending flange portion at the second end and a receiver extending axially outwardly from the hollow body portion. A clamp is operable to removably couple the first and second exhaust devices to one another and includes a clamp band circumferentially extending about the flange portion. An arm is fixed to the clamp and includes a radially extending portion extending through an aperture in the receiver to couple the clamp to the adapter. A travel limiter is coupled to the arm and restricts separation of the clamp from the adapter. The clamp remains moveable relative to the adapter after the travel limiter is coupled to the arm.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1:
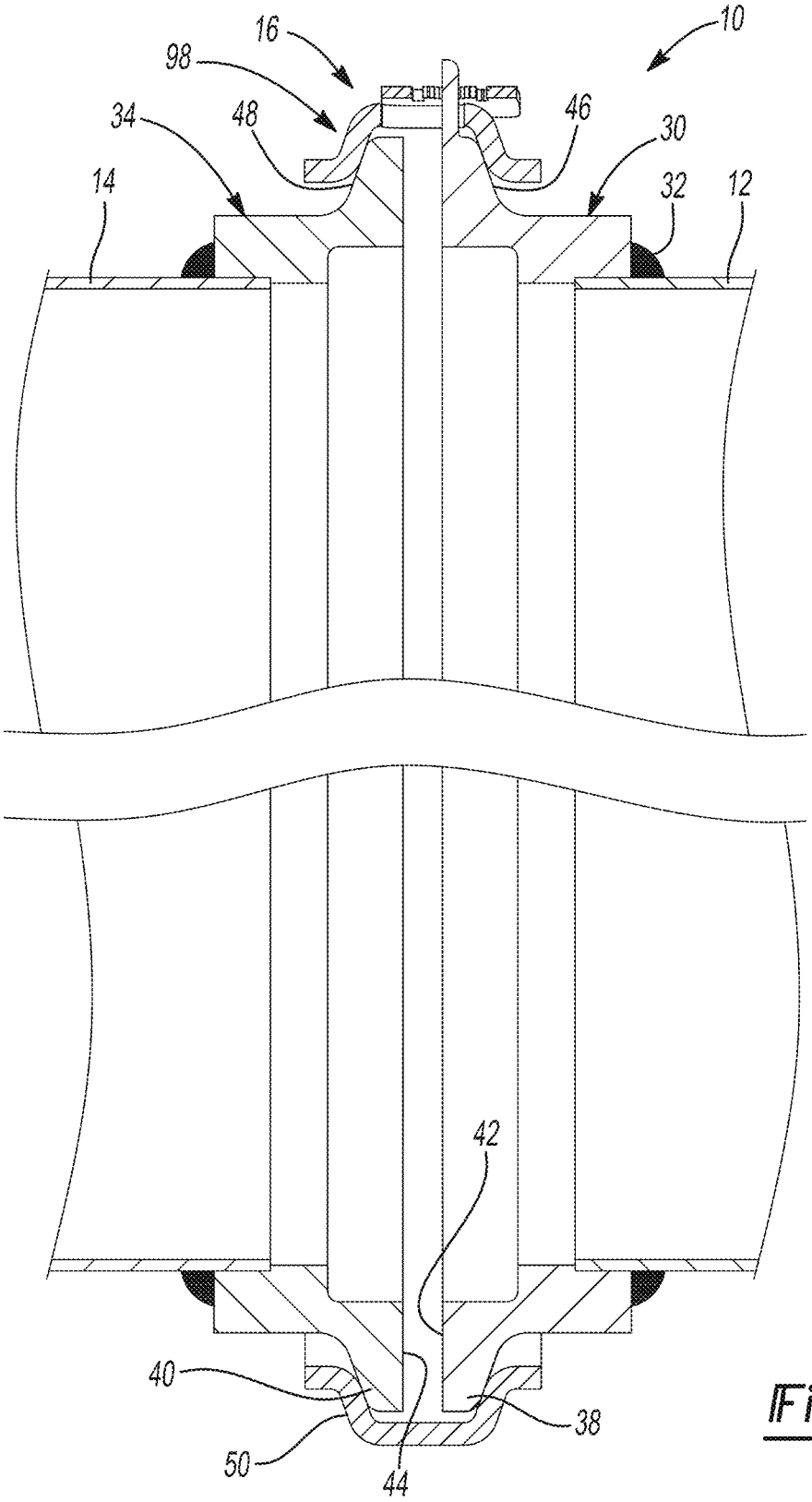
FIG. 1 is a fragmentary cross-sectional side view of an exhaust system including the clamp, adapter and travel limiter assembly of the present disclosure.
Figure 2:
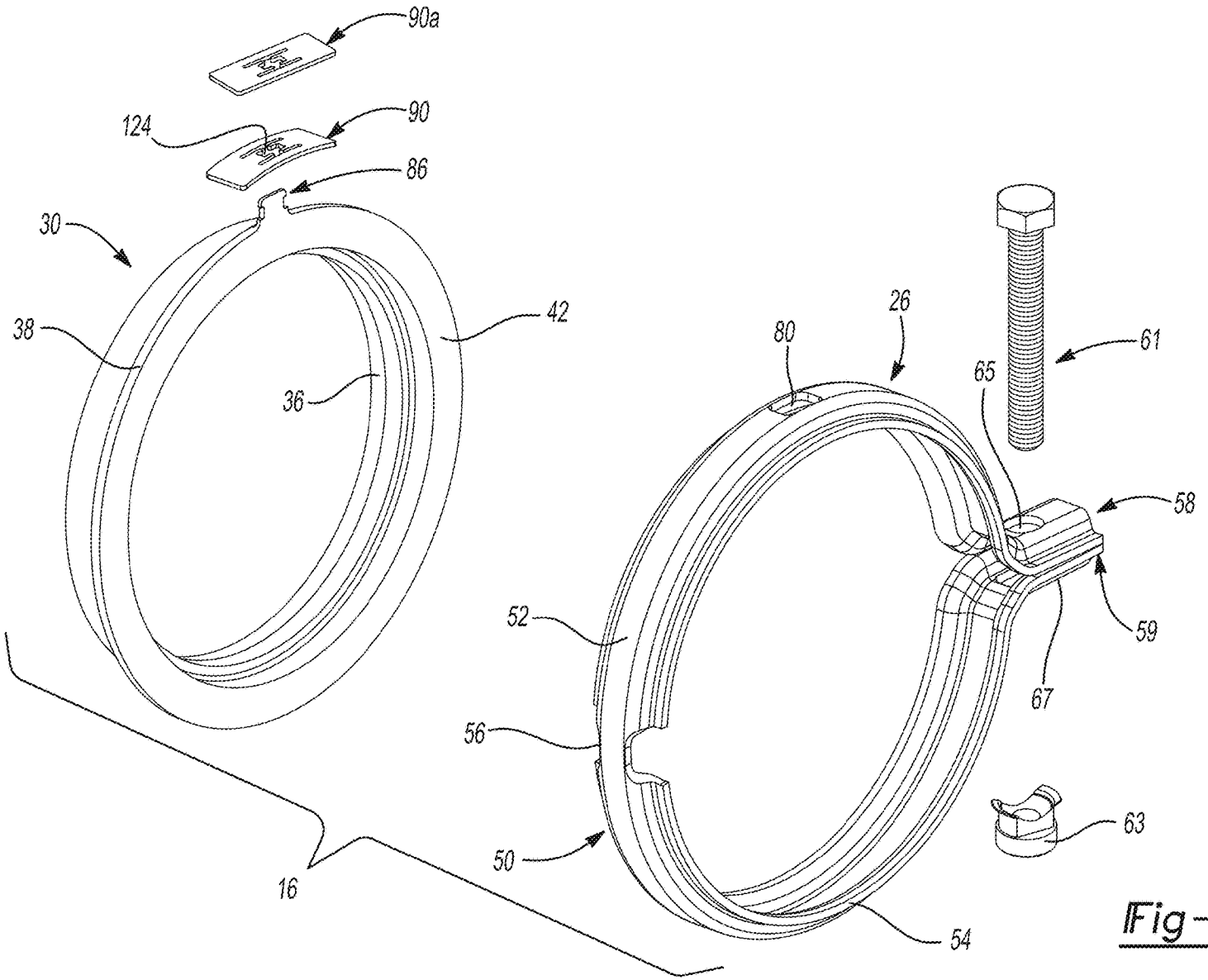
FIG. 2 is an exploded perspective view of the clamp, adapter and travel limiter assembly.

With reference to FIG. 1, a portion of an exhaust system 10 includes a first conduit 12, a second conduit 14, and a clamp, adapter and travel limiter assembly 16 interconnecting the first conduit 12 and the second conduit 14. Depending on the portions of the exhaust treatment system being interconnected, any number of exhaust devices may be considered as the first conduit 12 or the second conduit 14.

In the embodiment depicted in FIGS. 1-4, a first adapter 30 is positioned at an end of first conduit 12. First adapter 30 may be integrally formed with an exhaust device or may be a separate component fixed thereto. In this example, first conduit 12 is fixed to first adapter 30 via a weld 32. Similarly, a second adapter 34 is provided at an end of second conduit 14. Second adapter 34 may be integrally formed with second conduit 14 or may be a separate component fixed thereto. Alternatively, second adapter 34 may be a portion of an exhaust device.

First adapter 30 includes a hollow cylindrical body 36 and a radially outwardly extending first flange 38. Second adapter 34 includes a radially outwardly extending second flange 40. It should be appreciated that the interconnection between first flange 38 and second flange 40 may be configured as a male and female interconnection (not shown) or may be shaped as a butt joint where the first and second flanges 38, 40 engage one another but do not overlap one another. Specifically, a first sealing surface 42 of first flange 38 engages a second sealing surface 44 of second flange 40 when a clamp assembly 26 is fixed in place. First flange 38 includes a circumferentially extending first outer surface 46 having a frustoconical shape. Second flange 40 includes a circumferentially extending second outer surface 48 also having a frustoconical shape that is substantially the mirror image of first outer surface 46.

Clamp assembly 26 includes a unitary or monolithic one-piece clamp band 50 having a first clamp portion 52 joined to and a second clamp portion 54 by a hinge portion 56. First clamp portion 52 includes a distal first end 58 while second clamp portion 54 includes a distal second end 59. In a free or unloaded state, distal first end 58 is spaced apart from distal second end 59. As the distal first and second ends 58, 59 are moved towards one another, an inner diameter defined by first clamp portion 52 and second clamp portion 54 is reduced. To accomplish this relative movement between first clamp portion 52 and second clamp portion 54, clamp assembly 26 further includes a threaded bolt 61 and a mating threaded nut 63. Threaded bolt 61 extends through an aperture 65 formed in distal first end 58 as well as another aperture 67 formed in distal second end 59. It should be appreciated that the geometrical configuration of clamp band 50 is merely exemplary. An alternate arrangement comprises a 2-piece clamp band including a first clamp half rotatably coupled to a second clamp half at the location of hinge portion 56. Other relatively movable clamp components are also contemplated as being within the scope of the disclosure.

Figure 3:
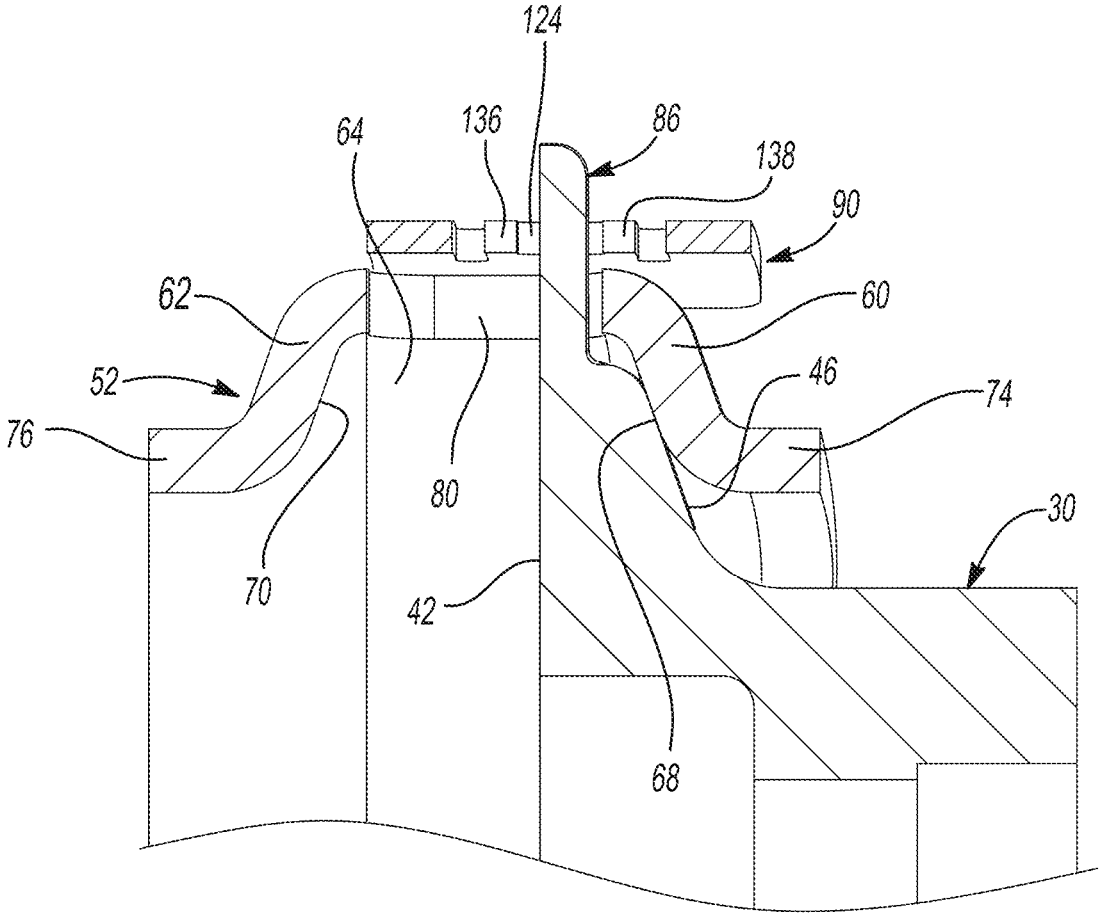
FIG. 3 is an enlarged fragmentary cross-sectional view of a portion of the exhaust system depicted in FIG. 1.

As best depicted in FIG. 3, first clamp portion 52 includes a first sidewall 60 and a second sidewall 62 interconnected by an end wall 64. First sidewall 60 and second sidewall 62 extend from end wall 64 at an angle greater than 90 degrees such that an inner surface 68 of first sidewall 60 and an inner surface 70 of second sidewall 62 extend relative to one another at an acute angle in the general shape of V. An axially extending first lip 74 extends from first sidewall 60. An axially extending second lip 76 extends from second sidewall 62. It should be appreciated that second clamp portion 54 exhibits the same cross-sectional geometry. At hinge portion 56, however, first sidewall 60, second sidewall 62, first lip 74, and second lip 76 are not present to allow this portion of the band to act as a hinge. First clamp portion 52 includes an aperture 80 extending through end wall 64. Aperture 80 is circumferentially spaced apart from distal first and second ends 58, 59 of clamp band 50 a predetermined number of degrees. The rotational position of aperture 80 relative to threaded bolt 61 and mating threaded nut 63 is set to assure a desired 'clocking" or rotational position of the clamp hardware. Access to threaded bolt 61 and mating threaded nut 63 with the requisite tools is desired to allow service.

Figure 4:
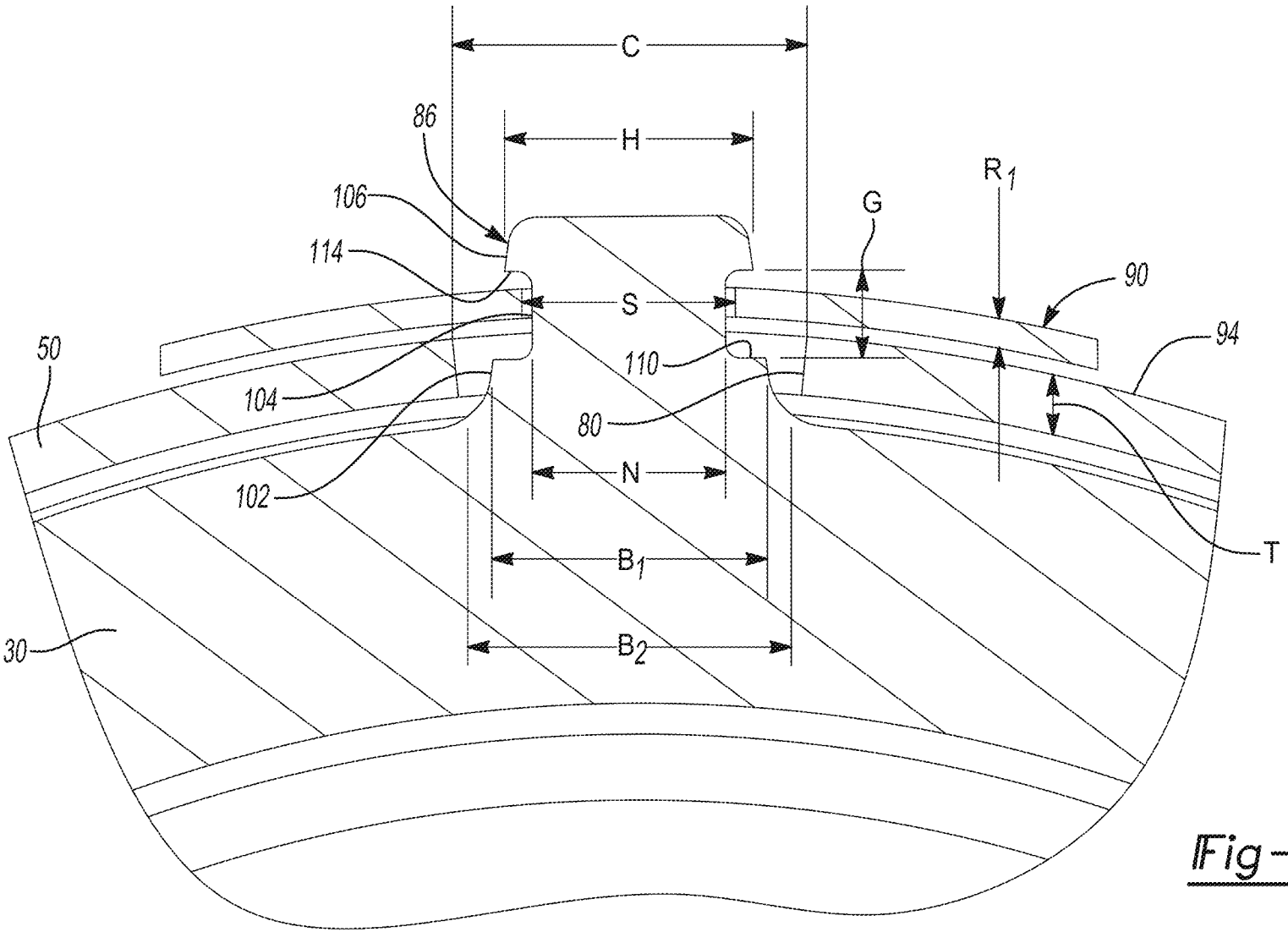
FIG. 4 is a fragmentary cross-sectional view taken perpendicular to the longitudinal axis of the exhaust system.

As most clearly depicted in FIGS. 3 and 4, first adapter 30 includes a post 86 radially outwardly extending from first flange 38. Post 86 extends through aperture 80 of first clamp portion 52 as will be described in detail later. A travel limiter 90 engages post 86 to couple clamp band 50 to first adapter 30. Travel limiter 90 and post 86 are configured to position travel limiter 90 at a location spaced apart from an outer surface 94 of clamp band 50. Aperture 80 and post 86 are sized and shaped to assure that clamp band 50 is moveable relative to first adapter 30 in all six degrees of freedom. In this manner, clamp assembly 26 including clamp band 50, threaded bolt 61 and nut 63 are coupled to first adapter 30 prior to shipping and handling procedures. The clamp assembly 26 remains moveably coupled to first adapter 30 to define clamp, adapter and travel limiter assembly 16 when initially aligning first conduit 12 and second conduit 14 for attachment to one another. By positioning travel limiter 90 at a spaced apart relationship to clamp band 50, second adapter 34 may simply be guided into contact with first adapter 30 such that second flange 40 is circumscribed by clamp band 50. Relative movement between exhaust devices and clamp assembly components is permitted to obtain the desired alignment prior to tightening clamp assembly 26 to the first adapter 30 and second adapter 34. During the tightening of clamp assembly 26, inner surfaces 68, 70 of clamp band 50 function as wedges in engagement with first outer surface 46 and second outer surface 48 thereby driving the first adapter 30 toward second adapter 34. First sealing surface 42 is driven into sealing engagement with second sealing surface 44.

In high volume assembly situations, it is important to minimize time and effort required to assemble subcomponents of an assembly. With the present arrangement, clamp, adapter and travel limiter assembly 16 may be fixed to first conduit 12 or a different exhaust device and thereby be prepared for attachment to second adapter 34 that may be disposed at a different physical location such as at an original equipment manufacturer's assembly plant. As mentioned, second adapter 34 may be simply a portion of an exhaust device. It should be appreciated that while a single aperture 80, post 86 and travel limiter combination are described per adapter, more than one set of these devices may be present, if desired.

Post 86 includes a base portion 102, a neck portion 104, and a head portion 106. Base portion 102 radially outwardly extends from first flange 38. Base portion 102 has a varying width ranging from $B_1$ to $B_2$. Aperture 80 includes a width C that is greater than the magnitude of $B_1$ and substantially similar to the size of $B_2$. In this manner, clamp band 50 may rotate to a certain extent relative to post 86. Neck portion 104 includes a width N while head portion 106 includes a width H. Neck portion width N has a magnitude less than $B_1$ and H. The position of neck portion 104 on post 86 defines a land 110 at the junction between base portion 102 and neck portion 104 as well as a catch 114 at the transition between neck portion 104 and head portion 106. A gap G has a magnitude as identified in FIG. 4 as the radial spacing between land 110 and catch 114. By way of relative comparison, travel limiter 90 includes a thickness $R_1$ while end wall 64 of clamp band 50 includes a thickness T. The magnitude of the gap G is greater than the sum of the travel limiter thickness $R_1$ plus the thickness of the travel limiter T. This dimensional relationship assures possible radial movement of clamp band 50 relative to first adapter 30 after travel limiter 90 is fixed to post 86.

Figure 5:
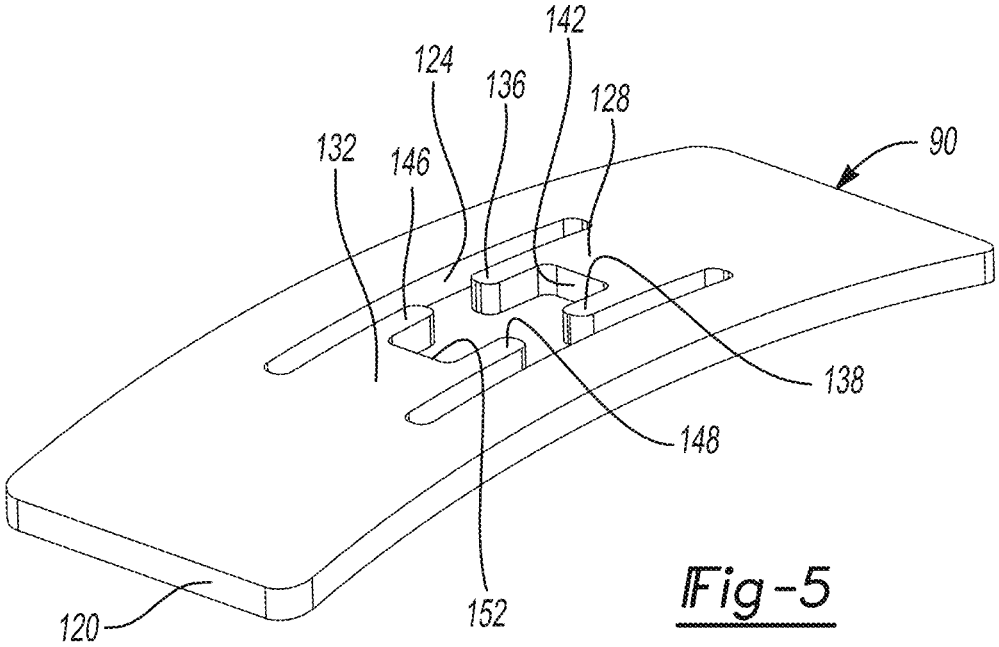
FIG. 5 is a perspective view of an exemplary travel limiter.

With reference to FIGS. 4 and 5, travel limiter 90 is depicted as having a curved shape. This shape is merely exemplary. It is also contemplated that travel limiter 90, and any other travel limiter discussed, may be shaped as a planar member such as shown at reference numeral 90*a*. Travel limiter 90 includes a substantially rectangularly shaped plate 120 including an aperture 124 extending therethrough. Aperture 124 has a relatively complex shape defining a first prong 128 and a diametrically opposed second prong 132. Travel limiter 90 is constructed from a resilient metallic material such as plastic or spring steel. Accordingly, first prong 128 and second prong 132 may be deflected radially inwardly or radially outwardly as the first and second prongs 128, 132 are cantilevered from plate 120 due to the shape of aperture 124. First prong 128 includes a first guide post 136 and a second guide post 138 axially spaced apart from one another. A first stop face 142 extends between first guide post 136 and second guide post 138. In a similar fashion, second prong 132 includes a third guide post 146, a fourth guide post 148, and a second stop face 152. As best viewed in FIG. 4, first stop face 142 is spaced apart from second stop face 152 a distance S. The magnitude of S is greater than neck portion width N but less than head portion width H and base portion width $B_1$.

To couple travel limiter 90 to post 86, aperture 124 is aligned with post 86. A radial inward force is applied to plate 120 of travel limiter 90 to cause first prong 128 and second prong 132 to radially outwardly deflect to such an extent that the spacing between first stop face 142 and second stop face 152 increases to the head portion width H and allows travel limiter 90 to radially translate over head portion 106 and into the gap between catch 114 and land 110. Due to the resiliency of travel limiter 90, first prong 128 and second prong 132 return to their original undeformed state after passing by head portion 106. At this time, clamp assembly 26 and travel limiter 90 are captured on post 86. First through fourth guide posts 136, 138, 146, 148 serve to rotationally align travel limiter 90 relative to post 86 as previously noted. Once the clamp, adapter and travel limiter assembly 16 is completely assembled, clamp assembly 26 maintains six degrees of freedom of movement relative to first adapter 30. Removal of clamp assembly 26 for service replacement is accommodated by deflecting the prongs out of position. It is contemplated that features of the clamp may accommodate deflecting the prongs out of engagement for removal of the travel limiter for service replacement.

Figure 6:
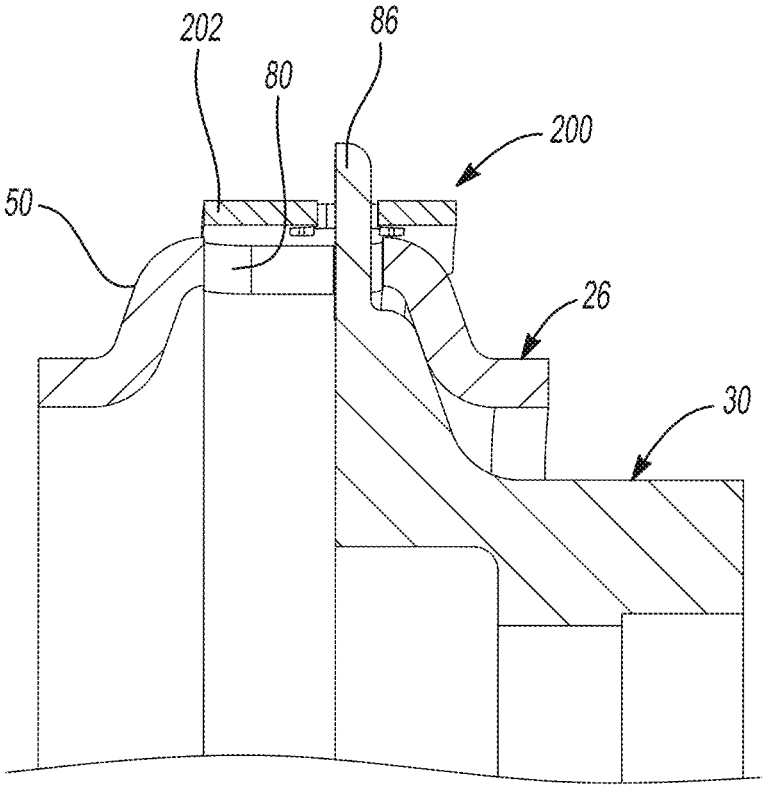
FIG. 6 is an enlarged fragmentary cross-sectional view of an alternate clamp, adapter and travel limiter assembly.
Figure 7:
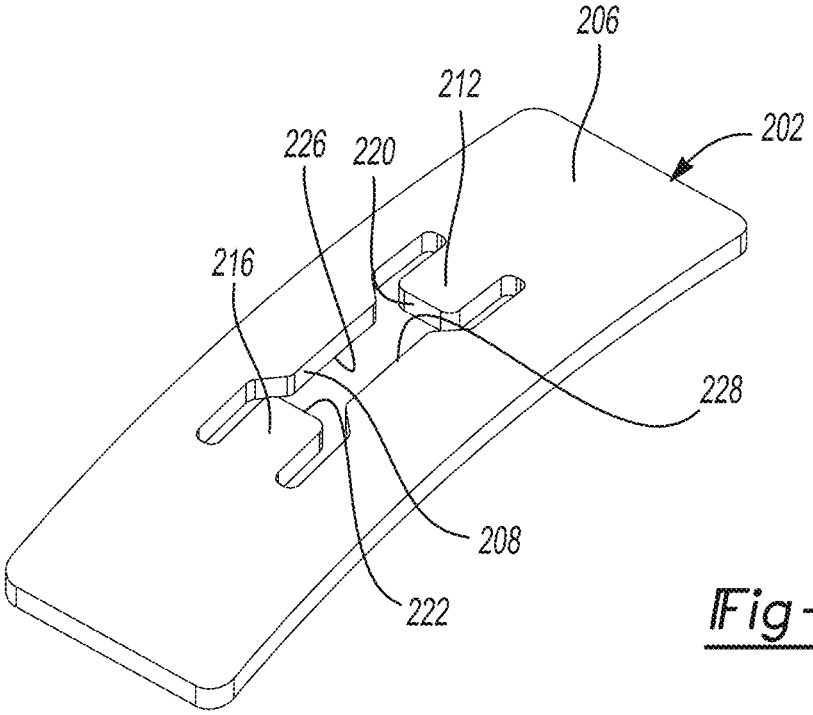
FIG. 7 is a perspective view of an alternate travel limiter.

A variety of other geometrical arrangements are contemplated, some of which are described in detail below. For example, FIGS. 6-7 depict another embodiment clamp, adapter and travel limiter assembly 200. It should be appreciated that clamp, adapter and travel limiter assembly 200 is configured to couple clamp assembly 26 to first adapter 30 in substantially the same manner as previously described. In this embodiment, travel limiter 90 has been replaced with a travel limiter 202. Travel limiter 202 includes a plate 206 that made be curved or substantially planar in shape. An aperture 208 extends through plate 206. Aperture 208 is shaped to define a first prong 212 diametrically opposed to a second prong 216. In similar fashion to the previously described travel limiter, travel limiter 202 is constructed from a resilient material that may be metal or plastic. Accordingly, first prong 212 and second prong 216 may be elastically deformed during assembly to post 86. Travel limiter 202 includes a first stop face 220 spaced apart from and extending substantially parallel to a second stop face 222. First stop face 220 is positioned at a distal end of first prong 212 while second stop face 222 is positioned at a distal end of second prong 216. Aperture 208 has a centralized portion delimited by a first side face 226 and a second side face 228.

First stop face 220 is spaced apart from second stop face 222 in a similar fashion and magnitude as previously described with reference to travel limiter 90. As such, first prong 212 and second prong 216 are elastically temporarily deformed as travel limiter 202 is pressed over head portion 106 of post 86.

Figure 8:
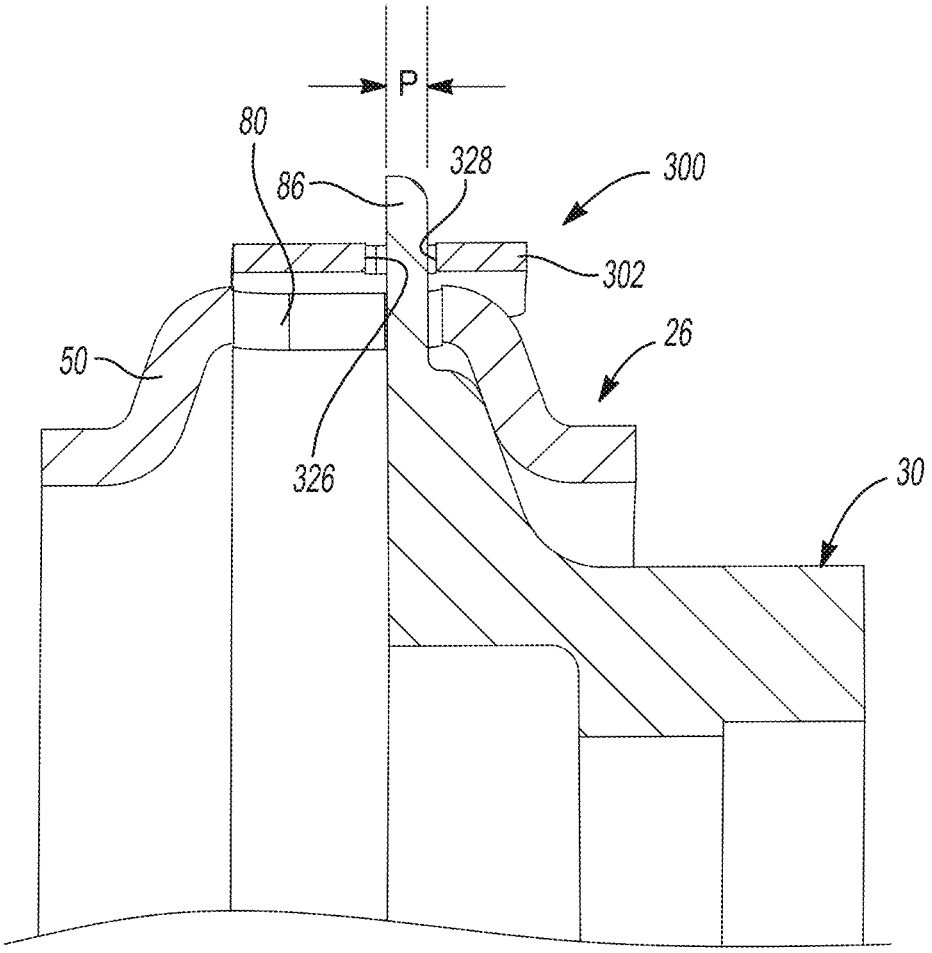
FIG. 8 is an enlarged fragmentary cross-sectional view of an alternate clamp, adapter and travel limiter assembly.
Figure 9:
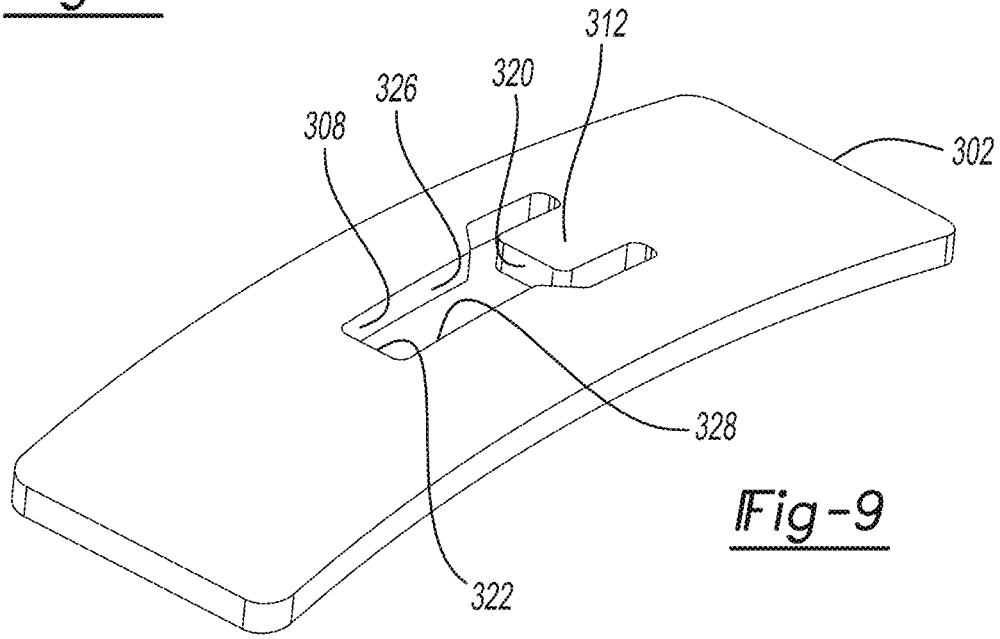
FIG. 9 is a perspective view of an alternate travel limiter.

FIGS. 8 and 9 depict another alternate clamp, adapter and travel limiter assembly identified at reference numeral 300. Once again, clamp assembly 26 and first adapter 30 including post 86 are included as previously described. An alternate travel limiter 302 replaces either of the previously described travel limiters. Travel limiter 302 is substantially similar to travel limiter 202 and includes an aperture 308 and a first prong 312. Only one selectively deformable prong is provided in this embodiment. A first stop face 320 extends parallel to and spaced apart from a second stop face 322 positioned at one extent of aperture 308. A spacing between first stop face 320 and second stop face 322 is of a magnitude less than head portion width H but more than neck portion width N. Aperture 308 is bounded by a first side wall 326 and a parallel and spaced apart second side wall 328. A spacing between first side wall 326 and second side wall 328 is greater than a thickness P of post 86 and substantially less than neck portion width N. Assembly of travel limiter 302 follows the same procedure as previously described with reference to travel limiters 90, 200.

Figure 10:
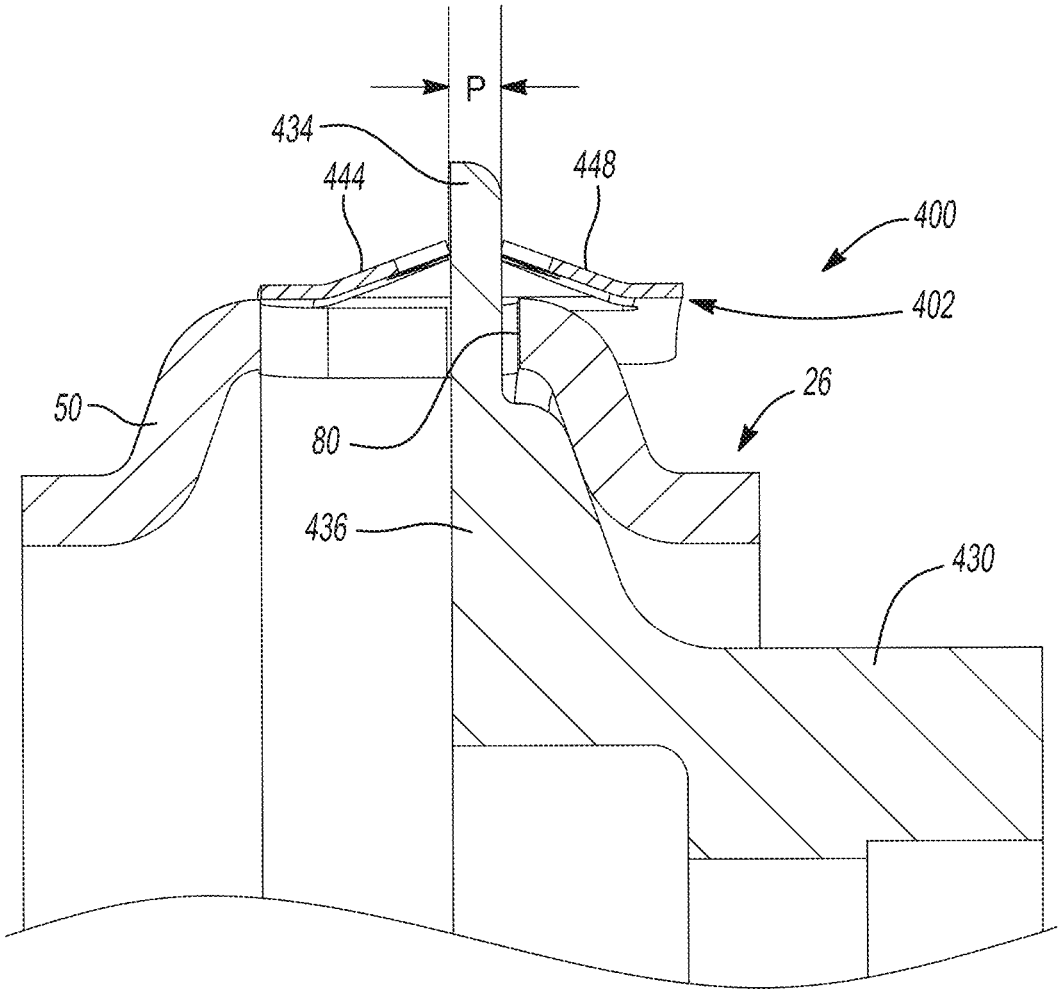
FIG. 10 is an enlarged fragmentary cross-sectional view of an alternate clamp, adapter and travel limiter assembly.
Figure 11:
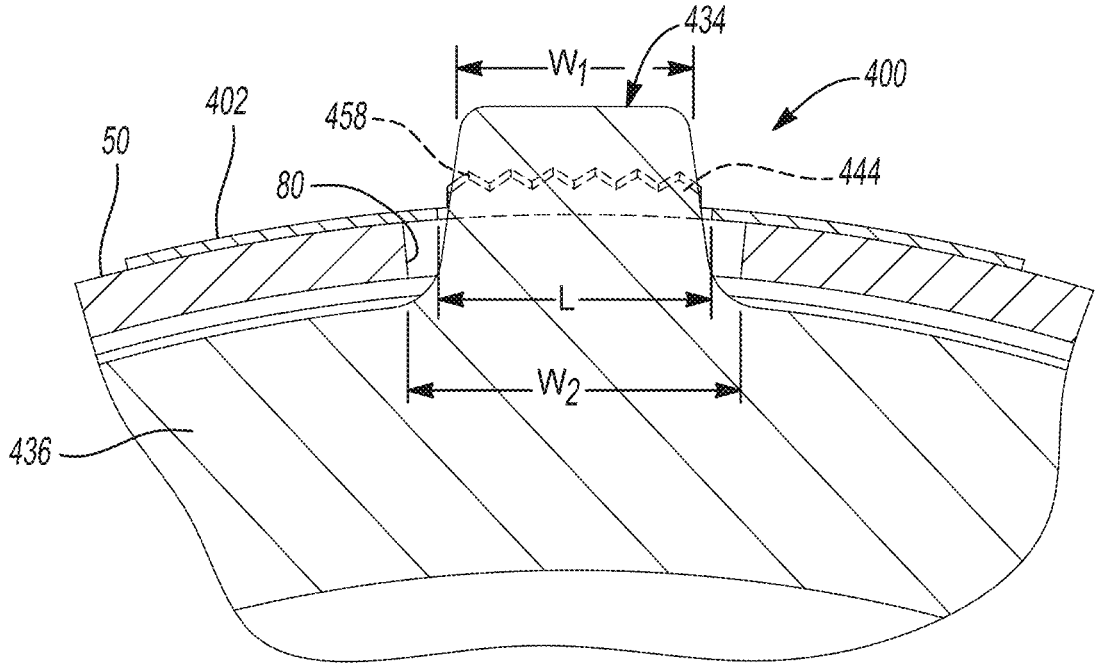
FIG. 11 is a fragmentary cross-sectional view of the clamp, adapter and travel limiter assembly depicted in FIG. 10.
Figure 12:
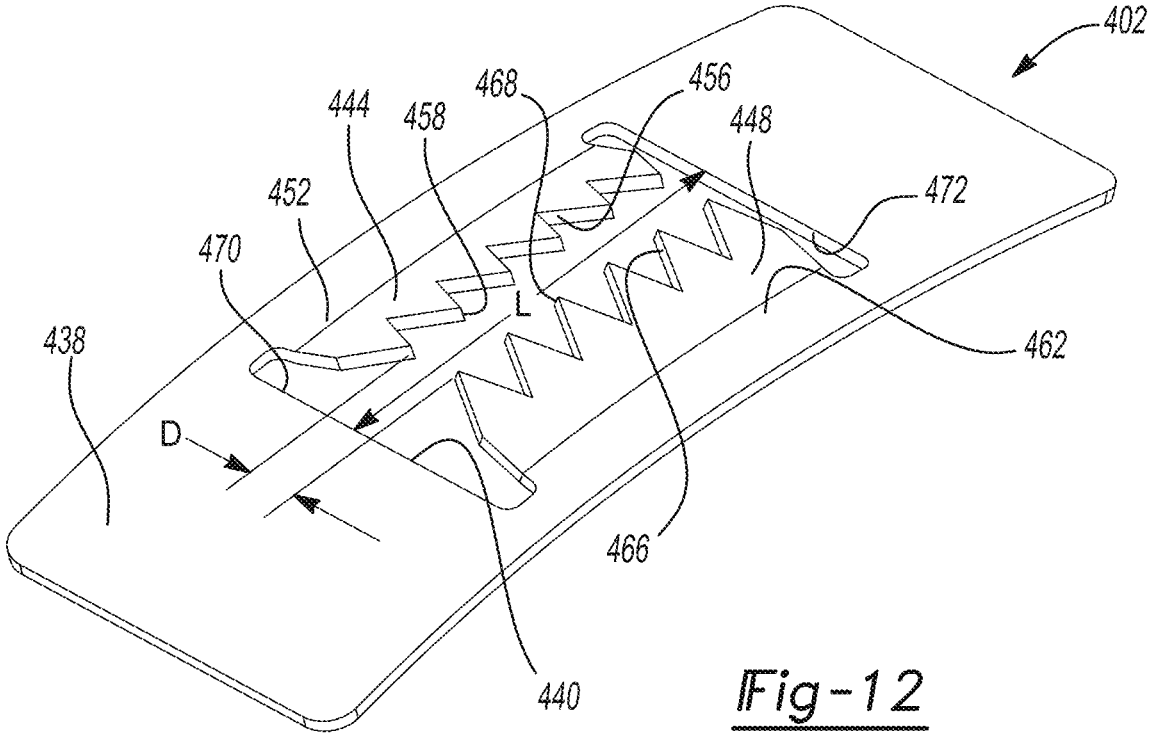
FIG. 12 is a perspective view of an alternate travel limiter.

Another alternate clamp, adapter and travel limiter assembly is depicted in FIGS. 10-12 and identified at reference numeral 400. In this arrangement, the same clamp assembly 26 may be utilized but alternate versions of a first adapter 430 and a travel limiter 402 are provided. First adapter 430 is substantially similar to first adapter 30. First adapter 430 includes a post 434 radially outwardly extending from a flange 436. Post 434 has a trapezoidal shape id cross-section as depicted in FIG. 11. Post 434 includes a width at its distal end identified as W1 and a wider portion at the interconnection of flange 436 having a width $W_2$. Aperture width C is greater than post width $W_1$ and substantially similar to the magnitude of width $W_2$. Post 434 also exhibits a thickness P.

With reference to FIG. 12 travel limiter 402 includes plate 438 with an aperture 440 extending therethrough. Aperture 440 defines a first jaw 444 and a diametrically opposed second jaw 448. First jaw 444 includes a proximal edge 452 and a distal edge 456. First jaw 444 is shaped as an upset tang radially outwardly extending from plate 438 a greatest distance at distal edge 456 and minimally at proximal edge 452. Teeth 458 area spaced apart from one another along distal edge 456. It should be appreciated that second jaw 448 is optional. If present, second jaw 448 is substantially the mirror image of first jaw 444. Second jaw 448 includes a proximal edge 462, a distal edge 466, and spaced apart teeth 468 formed along distal edge 466. Second jaw 448 is shaped as a tab bent radially outwardly and extending from plate 438. Teeth 458 are spaced apart from teeth 468 a distance D at their closest points which is less than post thickness P. Aperture 440 is bounded by a first edge 470 and an opposing second edge 472. The edges are spaced apart a distance L. Distance L is greater than $W_1$ but less than $W_2$.

After clamp assembly 26 is hung on post 434 by inserting post 434 through aperture 80, travel limiter 402 is radially pressed into engagement with post 434. The upturned and radially outwardly extending orientation of first jaw 444 and second jaw 448 urge a centralized orientation and alignment of travel limiter 402 with post 434. Upon exertion of a radially inwardly extending force on travel limiter 402, first jaw 444 and second jaw 448 resiliently bend further radially outward such that the spacing between teeth 458 and teeth 468 increases to post thickness P. At this time, travel limiter 402 is radially inwardly moved to a desired installed position. Radial inward movement of travel limiter 402 is limited by the relative sizes of $W_1$, $W_2$ and L. This position may include placing the travel limiter 402 into contact with outer surface 94 of clamp band 50. It should be appreciated that post 434 may include a land (not shown) positioned radially between the distal end of post 434 and flange 436. The land acts as a radial stop setting the installed position of travel limiter 402. Teeth 458 and teeth 468, if present, remain biasedly engaged with post 434 to retain clamp assembly 26 on the post.

Figure 13:
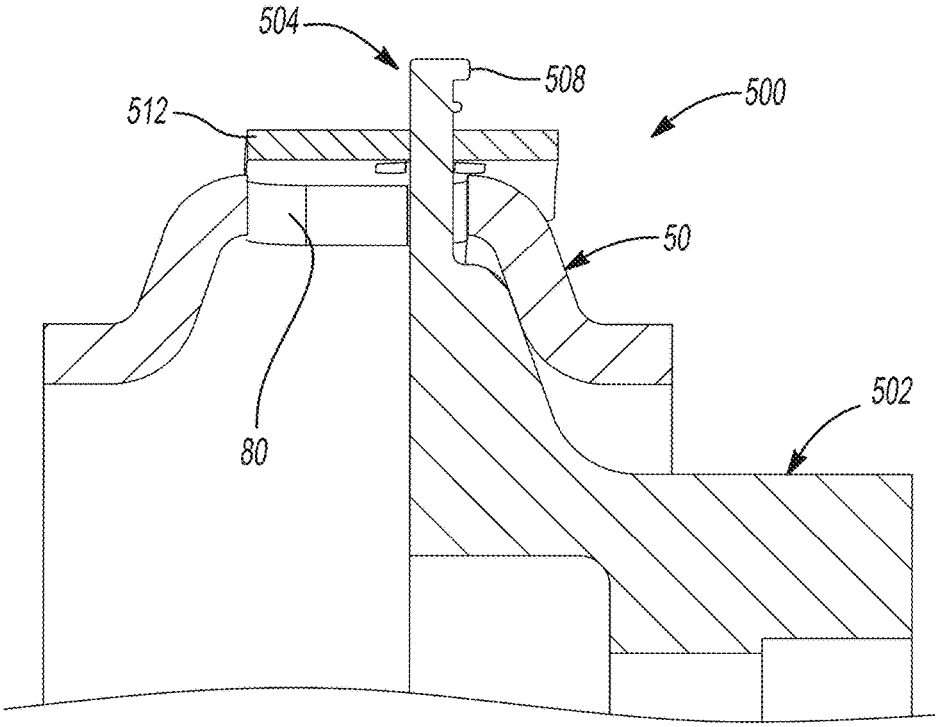
FIG. 13 is a fragmentary cross-sectional view of another alternate clamp, adapter and travel limiter, assembly.

FIG. 13 depicts another alternate adapter, clamp and travel limiter assembly identified at reference numeral 500. This embodiment includes an alternate first adapter 502 including a post 504. Post 504 includes an axially extending head portion 508 in lieu of circumferentially extending head portion 106, previously described. A travel limiter 512 may be sized and shaped similarly to any one of the previously described travel limiters but includes prongs or teeth oriented at ninety degrees to those previously described. The prongs or teeth engage post 504 in an area between head 508 and clamp band 50.

Figure 14:
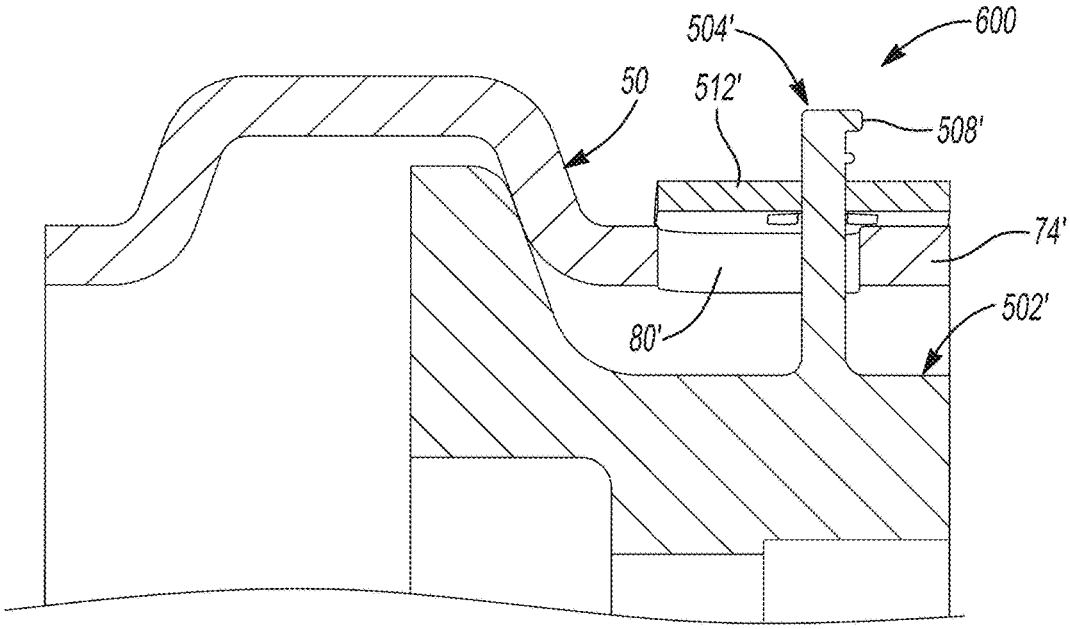
FIG. 14 is a fragmentary cross-sectional view of another alternate clamp, adapter and travel limiter, assembly.

FIG. 14 depicts another alternate adapter, clamp and travel limiter assembly identified at reference numeral 600. Assembly 600 is substantially the same as assembly 500 with the exception of the location of aperture 80'. Similar elements will be identified with like numerals including a prime suffix. Aperture 80' no longer extends through end wall 64 of first clamp portion 52. Aperture 80' extends through an enlarged axially extending lip 74'. It should be appreciated that the particular geometry of the travel limiter and post shown in FIG. 14 is merely exemplary. It is within the scope of the present disclosure that any one of the geometrical configurations previously described may be associated with aperture 80' extending through axially extending lip 74'.

Figure 15:
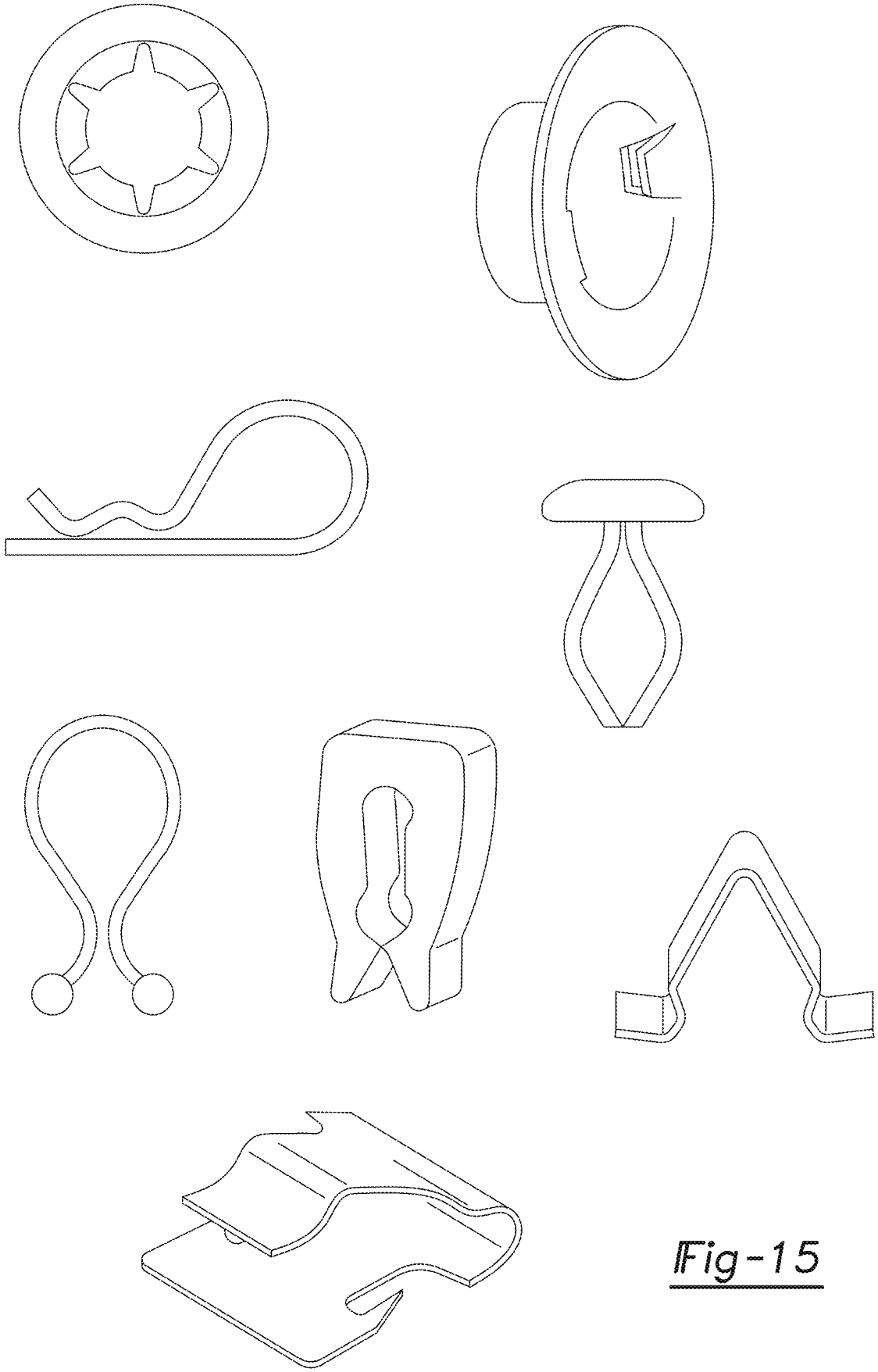
FIG. 15 depicts several alternate travel limiter configurations.
Figure 16:
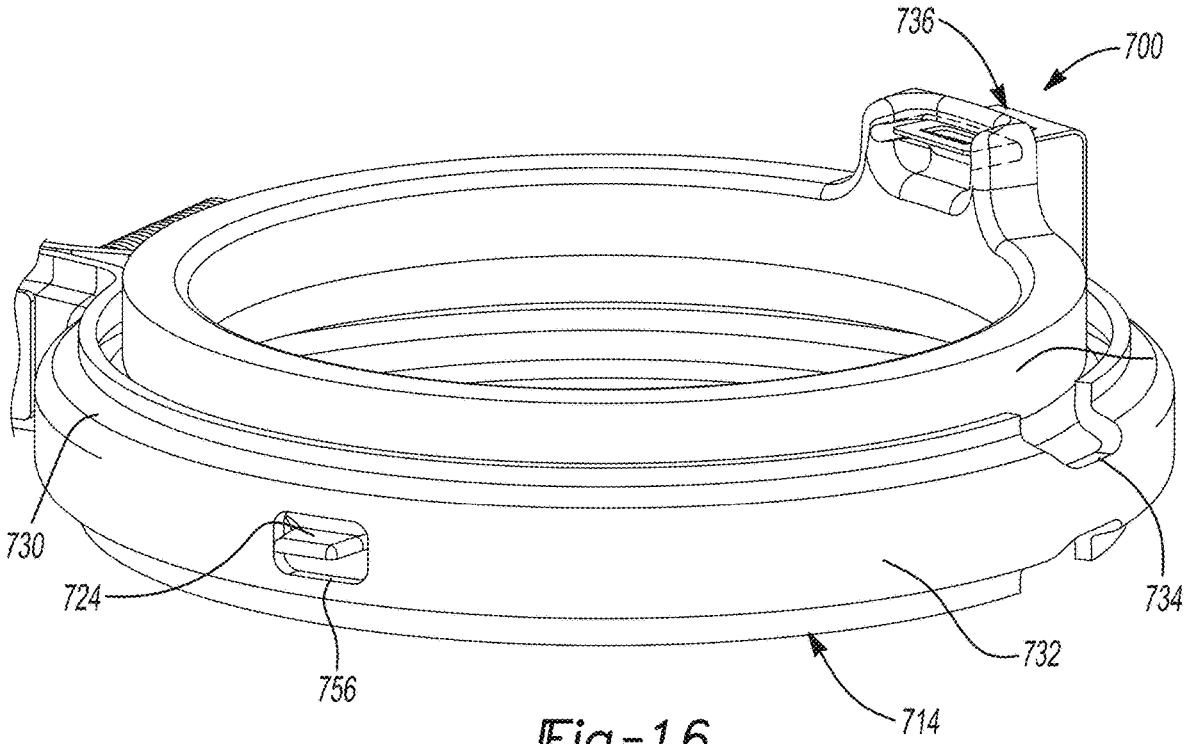
FIG. 16 is a perspective view of an alternate clamp, adapter and travel limiter assembly.
Figure 17:
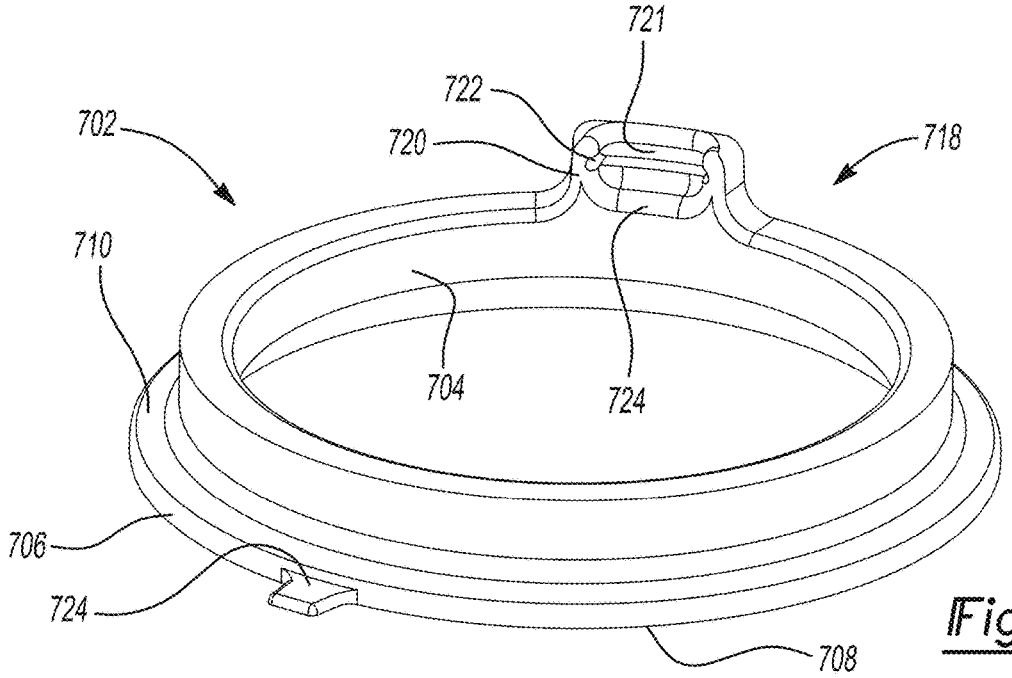
FIG. 17 is a perspective view of the adapter of the clamp, adapter and travel limiter assembly shown in FIG. 16.
Figure 18:
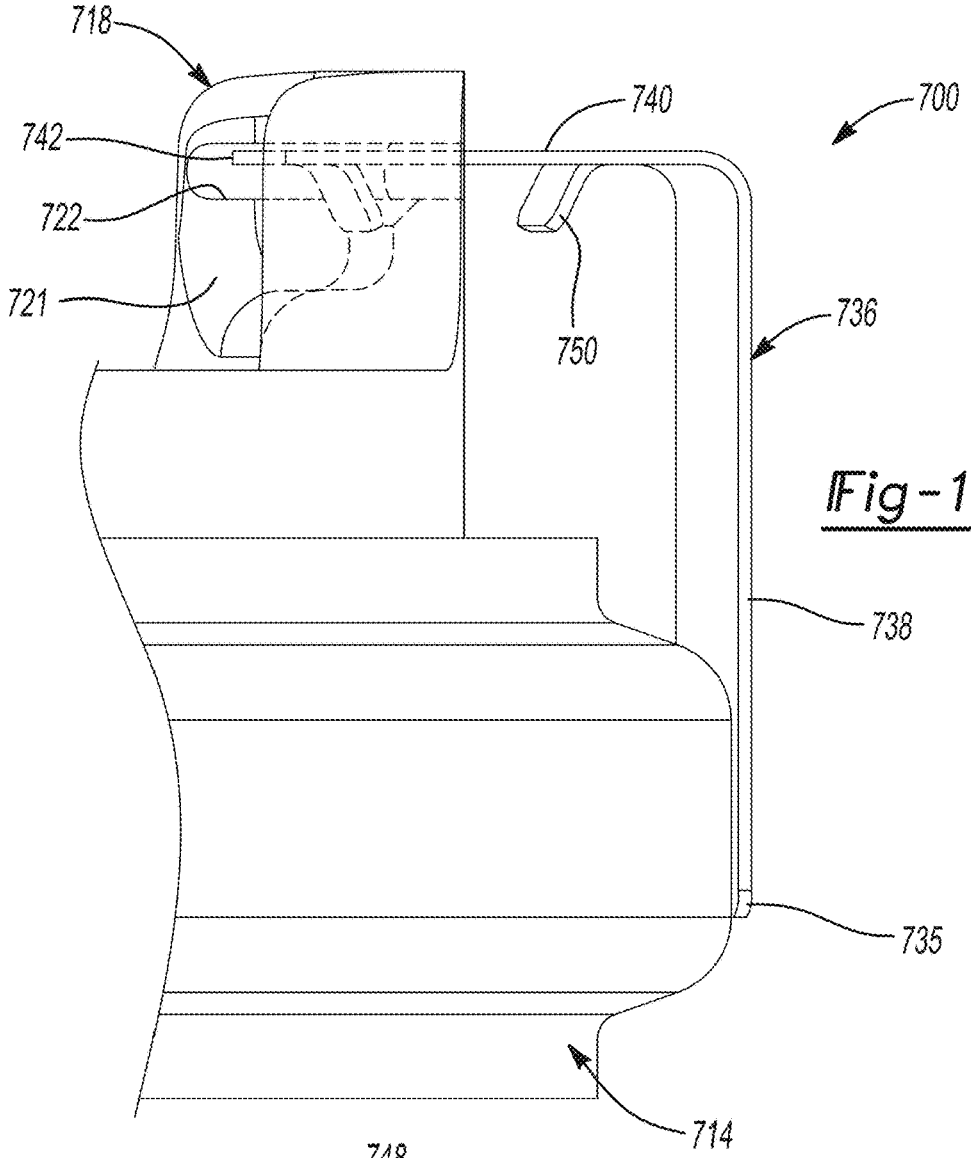
FIG. 18 is a side view of the clamp, adapter and travel limiter assembly shown in FIG. 16.
Figure 19:
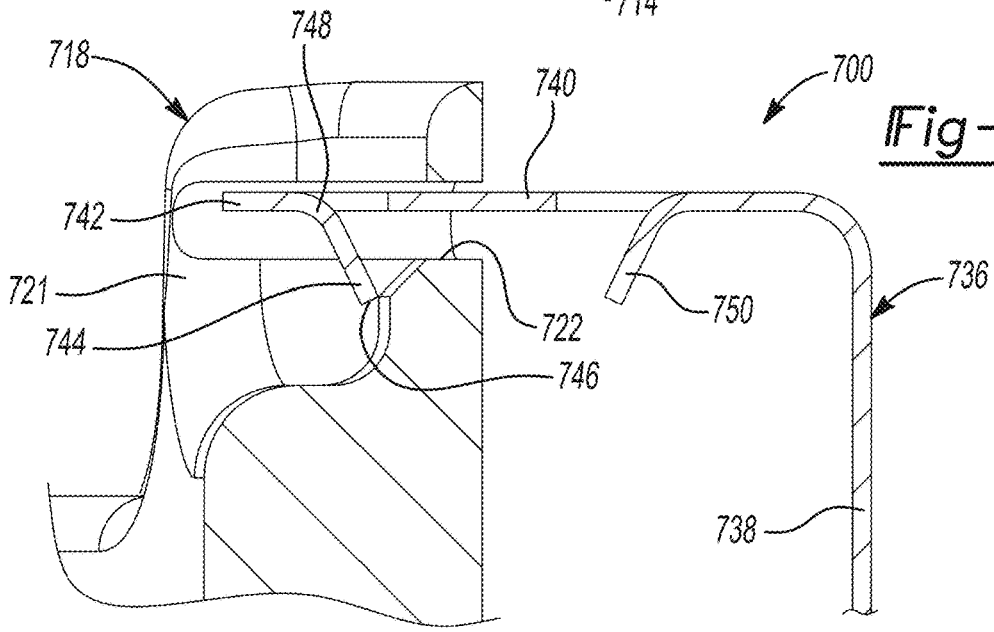
FIG. 19 is an enlarged fragmentary cross-sectional view of the clamp, adapter and travel limiter assembly shown in FIG. 16.

It should be appreciated that any of number travel limiters may be utilized in lieu of the embodiments described above. As nonlimiting examples, FIG. 15 provides other travel limiters operable to couple clamp assembly 26 to a given first adapter while maintaining six degrees of freedom of relative movement between clamp band 50 and the first adapter. At least one of the examples shown in FIG. 15 includes a cap operable to limit the amount axial travel of the travel limiter on a post radially extending from the first adapter. Once of the cap of the travel limiter engages the distal end of the post, the travel limiter may no longer travel further radially inward. As such, a predetermined spacing will be set between the most radially inward portion of the travel limiter and an outer surface of the first adapter such as outer surface 94 depicted in FIG. 4. A predetermined amount of "play" or relative movement for clamp band 50 is defined.

In alternate embodiments, it is contemplated that any one of the previously described travel limiters such as travel limiter 90, travel limiter 202, travel limiter 302, travel limiter 402, travel limiter 512, travel limiter 512', or any of the travel limiter embodiments depicted in FIG. 15 may be fixed to clamp band 50. The travel limiter may be fixed to clamp band 50 using any number of fixation methods including welding, mechanical fastening, adhesive bonding, or the like. It is understood that one relative degree of freedom between clamp assembly 26 and first adapter 30 may be eliminated. The remaining degrees of freedom of movement associated with the previously described interconnection mechanisms may be maintained when travel limiter 90, 202, 302, 402, 512, 512' is fixed to clamp band 50.

With reference to FIGS. 16-19, another alternate embodiment clamp, adapter and travel limiter assembly is identified at reference numeral 700. Assembly 700 is different than those previously described in that radially extending post 86 is replaced with an axially extending receiver.

Assembly 700 includes a first adapter 702 including a hollow cylindrical body 704 and a radially outwardly extending first flange 706 that includes a first sealing surface 708. First flange 706 includes a circumferentially extending first outer surface 710 having a frustoconical shape. Clamp, adapter, and travel limiter assembly 700 includes a clamp assembly 714 that is substantially similar to the clamp assemblies previously discussed with the exception that aperture 80 is no longer required, but optional. Clamp assembly 714 includes geometrical features sized and shaped to cooperate with first adapter 702 including first outer surface 710 as described in detail in relation to the earlier embodiments.

First adapter 702 includes an axially extending receiver 718 that is integrally formed with hollow cylindrical body 704. Receiver 718 includes a body 720 that is substantially rectangularly shaped in the embodiment depicted in the figures. It should be appreciated, however, that body 720 may exhibit nearly any shape and perform its desired function. A recess 721 is positioned at the distal end of body 720. An aperture 722 extends through body 720 of receiver 718. In at least one embodiment, first adapter 702 is manufactured using a casting process and each of the features previously described including body 720, recess 721, and aperture 722, may be formed during the casting process. In an alternate configuration, first adapter 702 may be cast to include receiver 718 but aperture 722 is not created during the casting process. Body 720 and recess 721 are defined during this casting process but aperture 722 is formed during a subsequent machining process.

First adapter 702 may optionally be equipped with a radially outwardly extending peg 724. Peg 724 may be used to "clock" or rotationally align the first adapter with clamp assembly 714. Peg 724 may also function as a hanger or retainer to maintain a desired position of clamp assembly 714.

Clamp assembly 714 includes a first clamp half 730 joined to a second clamp half 732 by a hinge 734. A first end 735 of an arm 736 is fixed to first clamp half 730 or second clamp half 732. Arm 736 includes a second end 742 opposite first end 735. Arm 736 includes an axially extending first portion 738 integrally formed with a radially extending second portion 740. Second portion 740 of arm 736 includes an axially inwardly extending catch 744. Catch 744 is spaced apart from second end 742 and is preferably integrally formed with second portion 740 and first portion 738. Catch 744 extends at an angle such that a distal end 746 of catch 744 is closer to first portion 738 than a proximal end 748 of catch 744. Arm 736 further includes a stop 750 axially extending from second portion 740. Stop 750 is also preferably integrally formed with first portion 738, second portion 740 and catch 744. Stop axially inwardly extends from second portion 740 and is radially spaced apart from catch 744.

To couple clamp assembly 714 to first adapter 702, second portion 740 of arm 736 is aligned with aperture 722. Arm 736 and first adapter 702 are axially moved toward one another. Second end 742 is inserted within aperture 722. Arm 736 continues to be inserted within aperture 722 as catch 744 is resiliently deformed. Insertion includes until catch 744 is positioned within recess 721 on the opposite side of first adapter 702 as first sealing surface 708. At this time, catch 744 functions as a barb and springs back to its undeformed position. Distal end 746 of catch 744 restricts withdrawal of catch 744 from aperture 722. Stop 750 limits axial travel of arm 736 in the opposite direction. Catch 744 acts as the travel limiter. Stop 750 may also act as the travel limiter.

In an optional arrangement, one or both of first clamp half 730 and second clamp half 732 includes an aperture 756 extending therethrough. Peg 724 is aligned with and extends through aperture 756 when clamp assembly 714 is coupled to first adapter 702.

Further areas of applicability of the present disclosure will become apparent from the detailed description, the claims and the drawings. The detailed description and specific examples are intended for purposes of illustration only and are not intended to limit the scope of the disclosure.

What is claimed is:

1. A clamp, adapter and travel limiter assembly for coupling first and second exhaust devices of an internal combustion engine exhaust system, the assembly comprising:

an adapter including a hollow body portion including a first end and an opposite second end, the first end being configured to be fixed to the first exhaust device, the adapter including a radially outwardly extending flange portion at the second end and a post extending radially outwardly from the flange portion:

a clamp operable to removably couple the first and second exhaust devices to one another and including a clamp band circumferentially extending about the flange portion, the clamp band including an aperture extending therethrough in receipt of the post; and a travel limiter coupled to the post and restricting removal of the clamp from the post, the clamp band remaining moveable relative to the adapter after the travel limiter is coupled to the post, wherein the travel limiter is shaped a sheet including an aperture extending therethrough, wherein the aperture is in receipt of the post.

2. The clamp, adapter and travel limiter assembly of claim 1, wherein the travel limiter includes a prong including a distal end, wherein the distal end of the prong engages the post at least during assembly of the travel limiter to the post.

3. The clamp, adapter and travel limiter assembly of claim 2, wherein the distal end of the prong remains engaged with the post after the travel limiter is disposed at a position radially outward from the clamp band.

4. The clamp, adapter and travel limiter assembly of claim 1, wherein the travel limiter is fixed to the clamp band.

5. The clamp, adapter and travel limiter assembly of claim 1, wherein the travel limiter includes a curved surface having a shape corresponding to an outer surface of the clamp band.

6. The clamp, adapter and travel limiter assembly of claim 1, wherein the post includes a head portion and a neck portion, the head portion having a width greater than a width of the neck portion.

7. The clamp, adapter and travel limiter assembly of claim 1, wherein the clamp band is an uninterrupted one-piece member.

8. The clamp, adapter and travel limiter assembly of claim 7, wherein the clamp includes a fastener coupled to opposite ends of the clamp band, the fastener being operable to change an inner diameter of the clamp band.

9. A clamp, adapter and travel limiter assembly for coupling first and second exhaust devices of an internal combustion engine exhaust system, the assembly comprising:

an adapter including a hollow body portion including a first end and an opposite second end, the first end being configured to be fixed to the first exhaust device, the adapter including a radially outwardly extending flange portion at the second end and a post extending radially outwardly from the flange portion:

a clamp operable to removably couple the first and second exhaust devices to one another and including a clamp band circumferentially extending about the flange portion, the clamp band including an aperture extending therethrough in receipt of the post; and a travel limiter coupled to the post and restricting removal of the clamp from the post, the clamp band remaining moveable relative to the adapter after the travel limiter is coupled to the post, wherein the post includes a head portion and a neck portion, the head portion having a width greater than a width of the neck portion, wherein the travel limiter includes a first surface, a second opposite surface and an aperture extending through both of the first and second surfaces, wherein the head portion is spaced apart from the first and second surfaces, wherein the first and second surfaces intersect the neck portion.

10. A clamp, adapter and travel limiter assembly for coupling first and second exhaust devices of an internal combustion engine exhaust system, the assembly comprising:

an adapter including a hollow body portion including a first end and an opposite second end, the first end being configured to be fixed to the first exhaust device, the adapter including a radially outwardly extending flange portion at the second end and a post extending radially outwardly from the flange portion:

a clamp operable to removably couple the first and second exhaust devices to one another and including a clamp band circumferentially extending about the flange portion, the clamp band including an aperture extending therethrough in receipt of the post; and a travel limiter coupled to the post and restricting removal of the clamp from the post, the clamp band remaining moveable relative to the adapter after the travel limiter is coupled to the post, wherein the post includes a land and a catch radially spaced apart from one another, the travel limiter being captured between the land and the catch.

11. A clamp, adapter and travel limiter assembly for coupling first and second exhaust devices of an internal combustion engine exhaust system, the assembly comprising:

an adapter including a hollow body portion including a first end and an opposite second end, the first end being configured to be fixed to the first exhaust device, the adapter including a radially outwardly extending flange portion at the second end and a post extending radially outwardly from the flange portion:

a clamp operable to removably couple the first and second exhaust devices to one another and including a clamp band circumferentially extending about the flange portion, the clamp band including an aperture extending therethrough in receipt of the post; and a travel limiter coupled to the post and restricting removal of the clamp from the post, the clamp band remaining moveable relative to the adapter after the travel limiter is coupled to the post, wherein the travel limiter includes an aperture in receipt of the post, the travel limiter including an upturned jaw having a distal end positioned within the aperture, the jaw being in biased engagement with the post.

12. The clamp, adapter and travel limiter assembly of claim 11, wherein the travel limiter includes another jaw diametrically opposed to the jaw, the another jaw being in biased engagement with the post.

13. A clamp, adapter and travel limiter assembly for coupling first and second exhaust devices of an internal combustion engine exhaust system, the assembly comprising:

an adapter including a hollow body portion including a first end and an opposite second end, the first end being configured to be fixed to the first exhaust device, the adapter including a radially outwardly extending flange portion at the second end and a post extending radially outwardly from the flange portion:

a clamp operable to removably couple the first and second exhaust devices to one another and including a clamp band circumferentially extending about the flange portion, the clamp band including an aperture extending therethrough in receipt of the post; and a travel limiter coupled to the post and restricting removal of the clamp from the post, the clamp band remaining moveable relative to the adapter after the travel limiter is coupled to the post, wherein the hollow body portion of the adapter defines a longitudinal axis, wherein the post includes a head portion and a neck portion, the head portion overhanging the neck portion in the longitudinal direction.

14. A clamp, adapter and travel limiter assembly for coupling first and second exhaust devices of an internal combustion engine exhaust system, the assembly comprising:

an adapter including a hollow body portion including a first end and an opposite second end, the first end being configured to be fixed to the first exhaust device, the adapter including a radially outwardly extending flange portion at the second end and a receiver extending axially outwardly from the hollow body portion:

a clamp operable to removably couple the first and second exhaust devices to one another and including a clamp band circumferentially extending about the flange portion;

an arm fixed to the clamp and including a radially extending portion extending through an aperture in the receiver to couple the clamp to the adapter; and a travel limiter coupled to the arm and restricting separation of the clamp from the adapter, wherein the clamp remains moveable relative to the adapter after the travel limiter is coupled to the arm.

15. The clamp, adapter and travel limiter assembly of claim 14, wherein the travel limiter includes a catch integrally formed with the arm as one-piece.

16. The clamp, adapter and travel limiter assembly of claim 14, wherein the travel limiter includes a resilient catch being deflected during insertion through the aperture, wherein the catch restricts removal of the radially extending portion from the receiver.

17. The clamp, adapter and travel limiter assembly of claim 16, wherein the receiver includes a body having a recess, the aperture being in communication with the recess, the recess being in receipt of the catch when the clamp is coupled to the adapter.

18. The clamp, adapter and travel limiter assembly of claim 14, wherein the arm includes a stop spaced apart from the travel limiter, the stop restricting movement of the radially extending portion in a direction of insertion beyond a predetermined distance.

19. The clamp, adapter and travel limiter assembly of claim 14, wherein the arm includes an axially extending portion, a catch, and a stop integrally formed with the radially extending portion as one-piece.

* * * * *